US006634867B2

(12) United States Patent
Pressel

(10) Patent No.: US 6,634,867 B2
(45) Date of Patent: Oct. 21, 2003

(54) SHUTTLE PISTON ASSEMBLY WITH DYNAMIC VALVE

(76) Inventor: Hans-Georg G. Pressel, P.O. Box 460413, Glendale Station, Denver, CO (US) 80246

( * ) Notice: Subject to any disclaimer, the term of this patent is extended or adjusted under 35 U.S.C. 154(b) by 0 days.

(21) Appl. No.: 09/976,816

(22) Filed: Oct. 12, 2001

(65) Prior Publication Data

US 2003/0072654 A1 Apr. 17, 2003

(51) Int. Cl.[7] ..... F04B 1/12; F04B 27/08

(52) U.S. Cl. ..... 417/269; 417/523; 417/545; 92/12.2; 92/181 R

(58) Field of Search ..... 417/269–273, 417/532, 902, 550.521, 532.523, 525, 545; 91/499–502, 505, 507; 92/12.2, 57, 71

(56) References Cited

U.S. PATENT DOCUMENTS

| | | | | | |
|---|---|---|---|---|---|
| 1,019,521 | A | * | 3/1912 | Pratt | 417/271 |
| 1,362,838 | A | | 12/1920 | Brandt | |
| 1,416,696 | A | | 5/1922 | Dennedy | |
| 1,451,033 | A | | 4/1923 | Todd | |
| 2,000,883 | A | | 5/1935 | Cullen et al. | |
| 2,089,630 | A | | 8/1937 | Teeter | |
| 3,004,810 | A | | 10/1961 | King | |
| 3,659,502 | A | * | 5/1972 | Friedman et al. | 92/84 |
| 3,685,923 | A | | 8/1972 | Hutchins et al. | |
| 4,275,999 | A | | 6/1981 | Hetzel et al. | |
| 4,297,086 | A | * | 10/1981 | McGowan | 417/271 |
| 4,487,556 | A | | 12/1984 | Wiernicki | |
| 4,507,059 | A | * | 3/1985 | Kobayashi et al. | 417/270 |
| 5,163,819 | A | * | 11/1992 | Pettitt | 417/269 |
| 5,266,015 | A | * | 11/1993 | Gannaway | 417/550 |
| 5,370,504 | A | * | 12/1994 | Nagashima | 417/234 |
| 5,421,243 | A | | 6/1995 | Burkett et al. | |
| 5,437,251 | A | * | 8/1995 | Anglim et al. | 123/56.3 |
| 5,452,994 | A | | 9/1995 | Erickson | |
| 5,492,459 | A | * | 2/1996 | Burkett et al. | 417/550 |
| 5,630,351 | A | * | 5/1997 | Clucas | 92/12.2 |
| 6,099,268 | A | | 8/2000 | Pressel | |
| 6,102,679 | A | | 8/2000 | Brown | |
| 6,382,939 | B2 | * | 5/2002 | Hashimoto et al. | 417/569 |

* cited by examiner

*Primary Examiner*—Charles G. Freay
*Assistant Examiner*—Han L Liu
(74) *Attorney, Agent, or Firm*—John E. Reilly

(57) ABSTRACT

A portable, high capacity air compressor system for charging air tanks over wide pressure ranges with maximum volumetric efficiency is characterized by employing a shuttle piston assembly in which piston pairs are arranged with axially aligned cylinder pairs to reciprocate in response to precession of a wobble plate, and each of the pistons is further characterized by being of one-piece construction with a built-in leaflet-type intake valve in its piston head, and a universal connector between each of the piston pairs and wobble plate which is stabilized within a pair of guide rails.

33 Claims, 10 Drawing Sheets

SHUTTLE PISTON ASSEMBLY WITH DYNAMIC VALVE

BACKGROUND AND FIELD OF INVENTION

This invention relates to pneumatic compressor systems; and more particularly relates to a novel and improved air compressor for charging storage tanks.

I previously devised a pneumatic pressure system for charging storage tanks and reference is made to U.S. Pat. No. 6,099,268, issued Aug. 8, 2000 entitled PNEUMATIC COMPRESSOR SYSTEM and co-pending Ser. No. 09/169,137, filed Jul. 18, 2000 entitled SWASH PLATE COMPRESSOR ASSEMBLY, and incorporated by reference herein. That system is characterized by being a swash plate type of air compressor capable of delivering pressures into the range of 200 psi and capable of charging different holding tanks so that each tank can serve as a self-contained source of pressurized air for various applications and resulted in decided improvements in terms of energy conversion, size and weight along with the noise associated with the operation of previous compressor designs.

Among other features, the swash plate technology employed in my previous patents resulted in substantial improvements in converting the wave-like or figure-eight pattern of movement of the swash plate into the reciprocal movement of the piston rods driven off of the swash plate through associated cylinders. The major limitation imposed upon the swash plate compressor as I designed resided in the number of cylinders for a given size or diameter of compressor system and therefore the maximum storage capacity and volumetric efficiency available. Of additional importance is to achieve pressures in the range of 135 psi and volumetric efficiency on the order of 53.96% and as high as 77.1% for smaller-sized air tanks which impose limitations on the size of air compressor that can be utilized to charge the tank.

Accordingly, there is a continuing need for a portable, high capacity air compressor system for charging air tanks over wide pressure ranges with increased volumetric efficiency while maintaining a simplified, compact compressor design; and at the same time it is important to maintain the most compact design possible so as to be readily insertable into the maximum range of air tank configurations and sizes.

SUMMARY OF THE INVENTION

It is therefore an object of the present invention to provide for a novel and improved air compressor.

It is another object of the present invention to provide for a novel and improved air compressor system which is capable of converting precessional movement of a swash plate into reciprocal movement of a series of piston rods whereby to cause the piston heads or domes associated with the piston rods to become axially aligned with their respective cylinders at the end of each piston stroke.

A further object of the present invention is to provide for dual cylinders on a common piston rod to increase the volumetric displacement of an air compressor system for a given diameter; and further wherein a stabilizer is interposed between cylinder pairs of each piston assembly to minimize stress on the piston rods by maintaining proper alignment between the rods and their respective cylinders.

A still further object of the present invention is to provide for a novel and improved air compressor system for charging air tanks and which is characterized by increasing the storage capacity of the tanks in serving as a stand-alone source of pressurized air for different applications.

It is an additional object of the present invention to provide for a novel and improved air compressor system for charging air tanks of different sizes and for a wide range of applications requiring medium pressure in excess of 90 psi.

The present invention resides in a novel and improved air compressor system which is operable alone or in combination with one or more air tanks for the delivery of pressurized air from the compressor into the tank. In order to achieve delivery of air pressure exceeding 90 psi with maximum volumetric efficiency, the air compressor system comprises a motor driven swash plate which translates rotational movement into reciprocal movement of a plurality of circumferentially arranged piston rods, each piston rod including a piston head at one end which is reciprocal through one of a pair of mutually opposed cylinders, each piston rod and piston head being of one-piece construction. Additionally, each piston head is provided with a dynamic leaflet valve mounted thereon and serving as an intake valve, and each cylinder has a cylinder head with an exhaust valve mounted therein to accelerate the opening and closing movement of the respective valve in response to reciprocal movement of the piston heads through their respective cylinders. A universal connection made up of mutually perpendicular fork connectors serves to connect an intermediate portion of each piston rod to the periphery of the swash plate and, with the aid of a stabilizer member, compensates for variations in rotational and radial movement of the piston rods away from a longitudinal axis extending through the cylinders as the rods are reciprocated by the swash plate. The system design as described eliminates the standard intake manifold common to air compressors and which tend to restrict air flow; and the air intake volumetric size is increased by locating the intake valve in the piston head and the exhaust valve in the cylinder head.

There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENT

Figure 1:
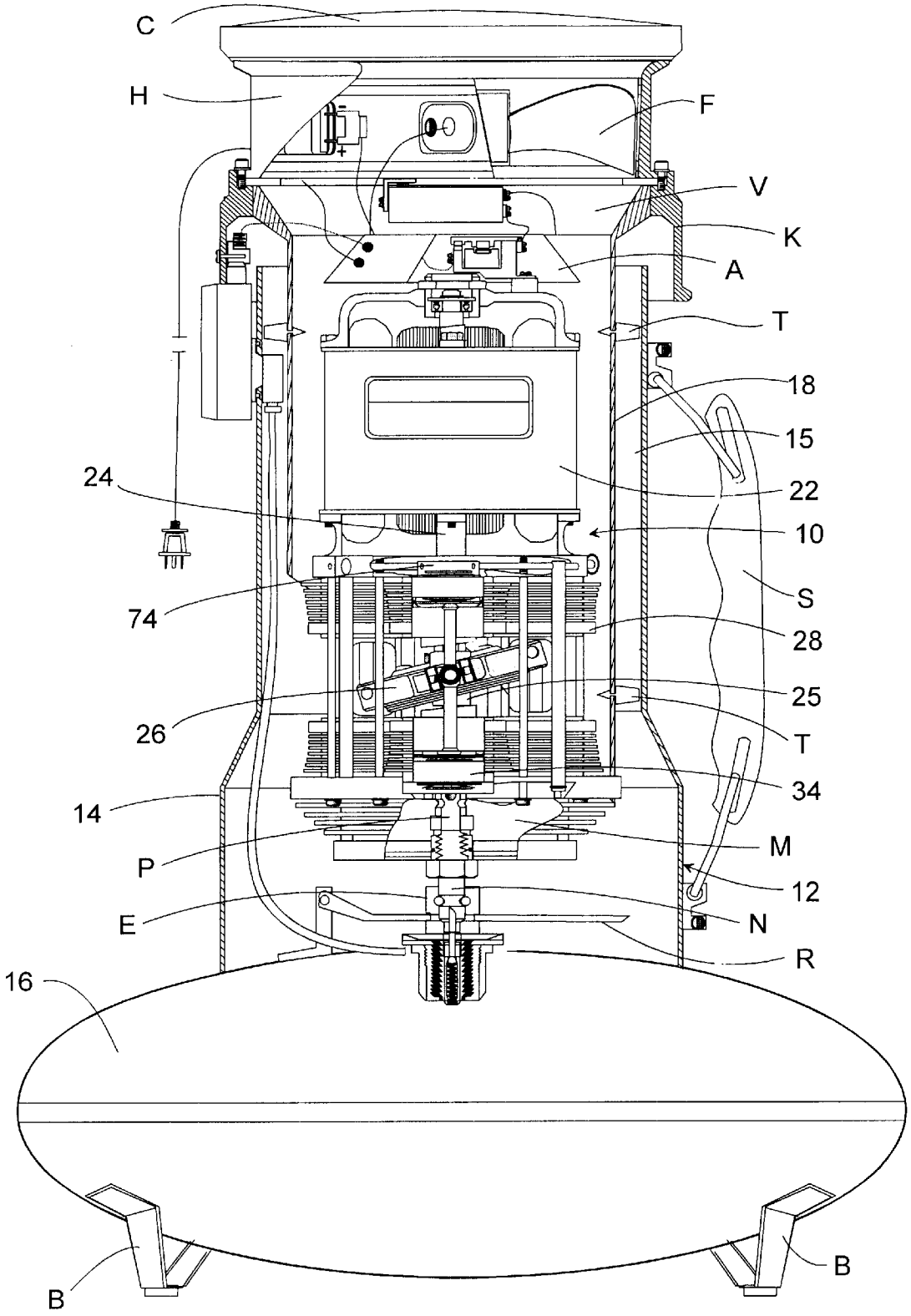
FIG. 1 is a front view in elevation of an air tank with portions broken away to illustrate the preferred form of air compressor assembly mounted therein.
Figure 2:
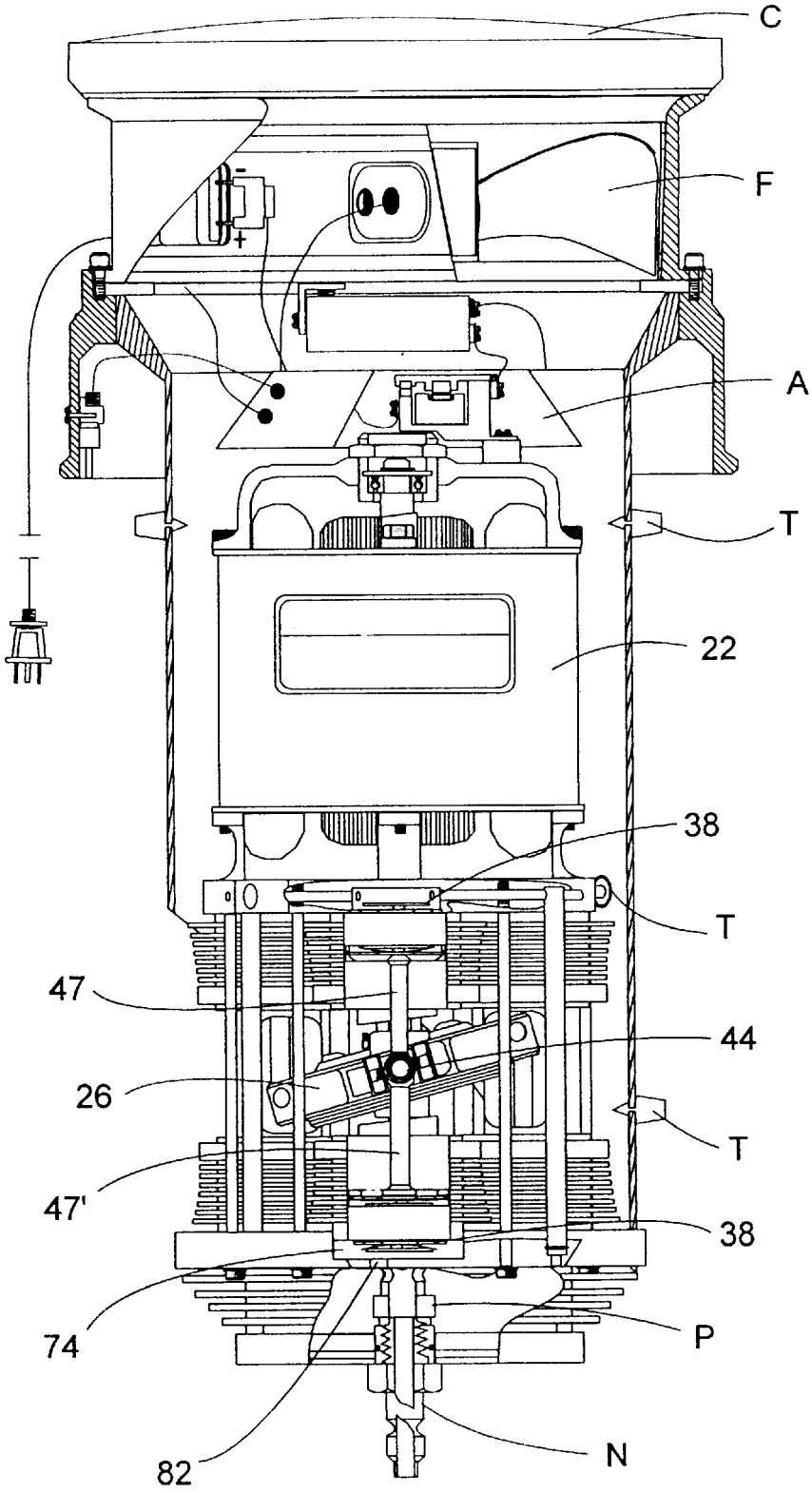
FIG. 2 is an enlarged view in more detail of the preferred form of air compressor assembly shown in FIG. 1.
Figure 3:
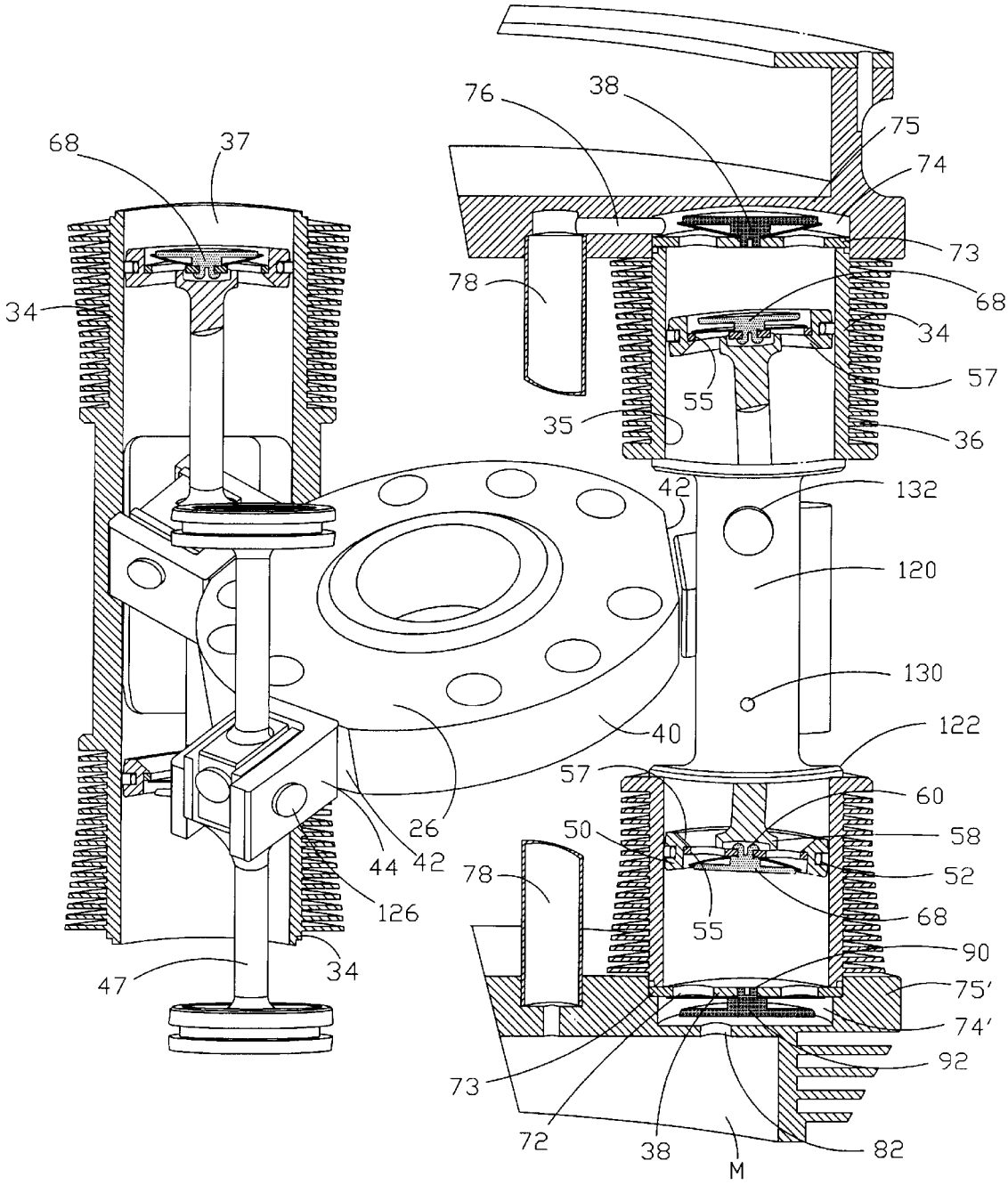
FIG. 3 is a perspective view of a swash plate, pistons and cylinders illustrating movement of the pistons through their respective cylinders.

Referring in detail to the drawings, there is illustrated in FIGS. 1 to 3 a preferred form of air compressor assembly 10 releasably inserted in an air tank assembly 12, the latter including an upper tubular housing 14 with liner 15 and air chamber 16. The basic construction and arrangement of the air tank 12 corresponds to that described in my hereinbefore referred to U.S. Pat. No. 6,099,268 and is merely representative of various types of air tanks with which the air compressor 10 may be employed. Broadly, however, the tank is provided with a carrying strap S and a plurality of spacers T on outer wall 18 of the compressor assembly 10 to establish uniform spacing of the compressor 10 inside of the tank liner 15, and a discharge nipple N at the lower end of the compressor assembly 10 is insertable through a chuck E centrally located in the chamber 16. Although not shown, the chamber 16 is provided with an access port for a conventional discharge hose for removal of air from the chamber when desired, and another port at the lower end of the chamber is provided for draining any water which condenses out of the compressed air within the chamber 16. Also, the tank assembly includes suitable feet B at spaced intervals around the bottom of the chamber 16 to support the entire assembly in a vertical position. It will become readily apparent however that the compressor assembly 10 can be releasably inserted into different tank sizes and configurations whether in a vertical, horizontal or angular disposition in order to successively charge or pressurize each tank assembly, for example, in the manner described in my hereinbefore referenced U.S. Pat. No. 6,099,268 and which patent has been incorporated by reference herein.

Brief mention will be made of conventional parts of the compressor assembly more as a setting or introduction for the novel features of the present invention. Accordingly, referring again to FIG. 1, the assembly 10 includes a compressor motor 22 for imparting rotation to a drive shaft 24 having an angled hub 25. A swash plate 26 is journaled on the angled hub 25 to undergo precessional motion in the basic form of a figure-eight in response to rotation of the drive shaft 24 thereby to compress the air drawn into a series of cylinders 28 in a manner to be hereinafter described. Air is drawn into the compressor assembly 10 through an upper filter cap C which is surmounted on a fan housing H for a two-stage fan F. The air drawn through the fan housing by the fan F is discharged through a venturi V and air diffuser A downwardly through the annular space surrounding the motor 22. A muffler skirt K is disposed in surrounding relation to the air diffuser A for the purpose of dampening noise. Further, as a standard part of the compressor assembly 10, air which is compressed by cylinders 34 and stored in manifold M can be selectively delivered through a high pressure stem P and the discharge nipple N which is releasably connected to an air chuck E. The air chuck E is mounted on the air chamber 16 of one of the air tank assemblies as previously described by a release lever R, as illustrated and described in more detail in my hereinbefore referenced U.S. Pat. No. 6,099,268.

FIG. 3 illustrates in more detail the preferred relationship between a plurality of cylinders 34 which are arranged in circumferentially spaced, oppositely directed pairs, each pair aligned on substantially a common longitudinal axis and facing in opposite directions away from one another. Specifically, each cylinder 34 of a pair is hollow with an outer straight cylindrical wall section 35 provided with cooling fins 36, the wall section 35 being open at both ends 37 and terminates in an exhaust valve 38 to be hereinafter described. The swash plate 26 is arranged centrally between the cylinder pairs 34 and is provided on its outer peripheral edge 40 with circumferentially spaced flat or tangential surface portions 42 for the mounting of universal connectors 44 for a shuttle piston assembly made up of piston pairs for each respective pair of cylinders 34.

Figure 4:
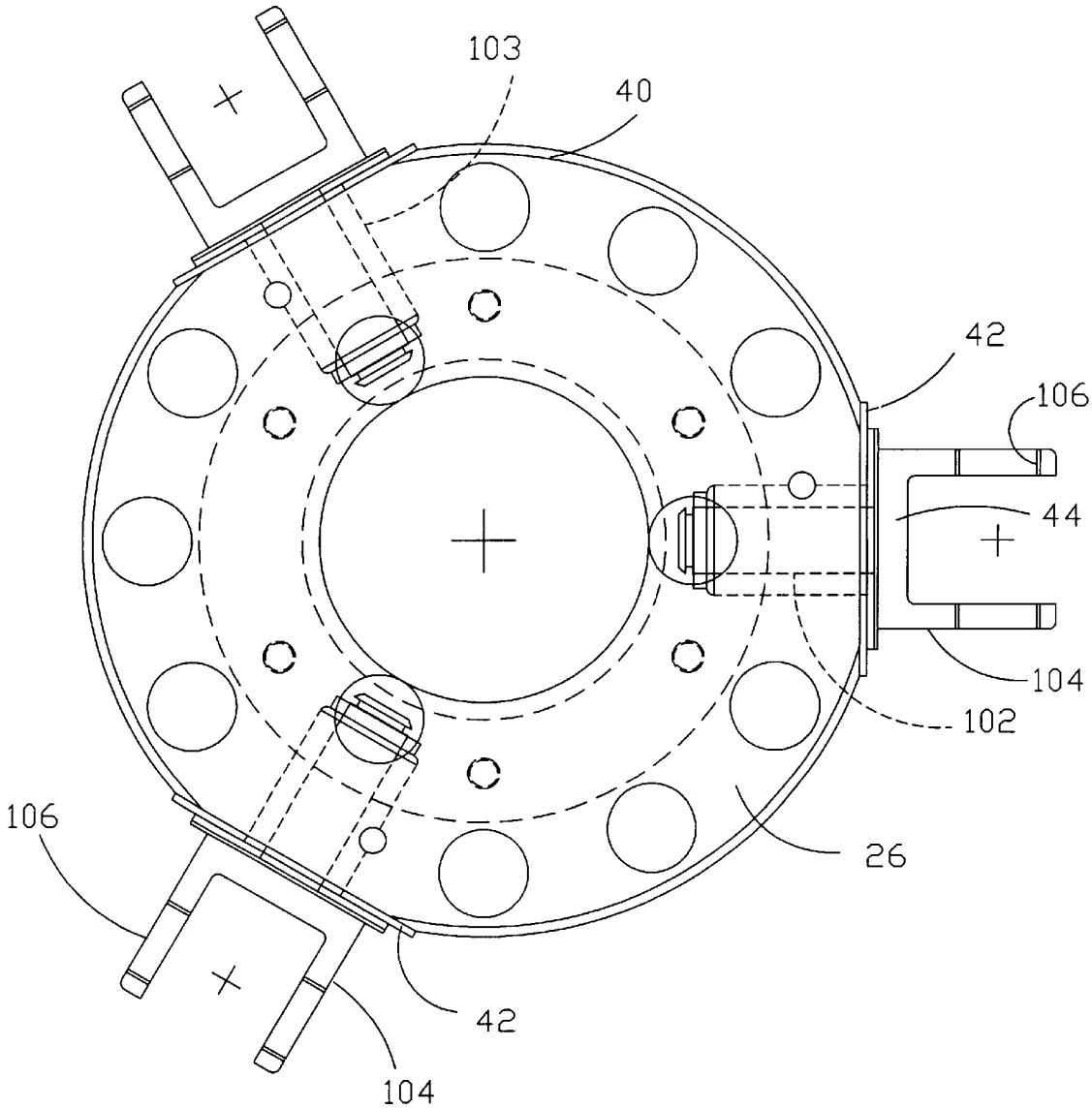
FIG. 4 is a top plan view of the swash plate and portion of the universal joint for the shuttle pin assembly.
Figure 5:
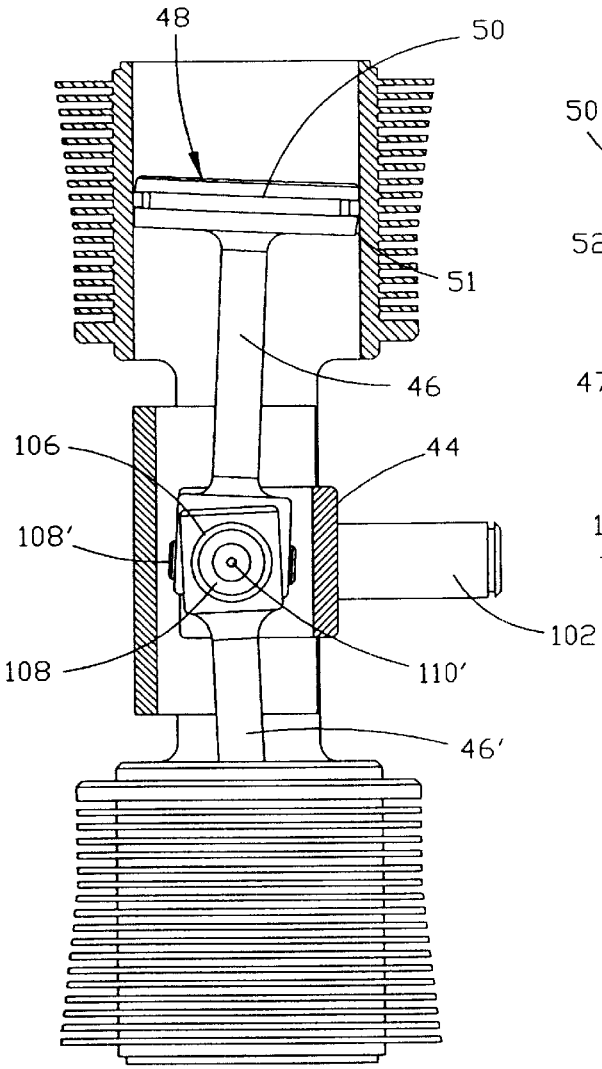
FIG. 5 is a side view partially in section of a cylinder pair and pistons with common connecting ends therebetween.
Figure 6:
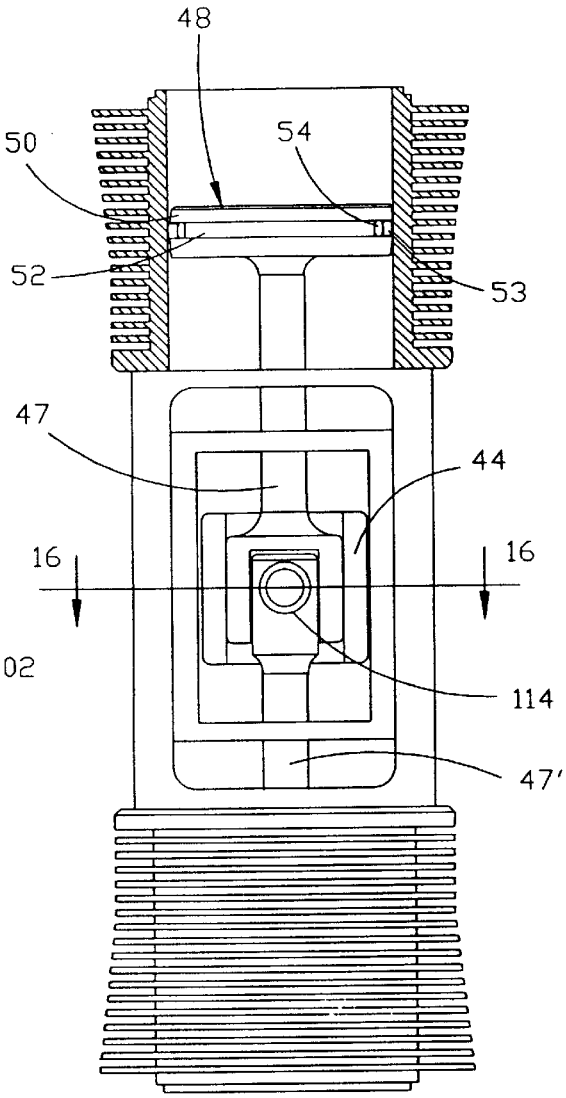
FIG. 6 is a front view partially in section of the assembly shown in FIG. 5.

As shown in FIGS. 3 to 5, each of the piston pairs comprises a piston member 46 having a connecting rod 47 extending away from the universal joint 44 and terminating in a piston head 48 which is slidable through one of the cylinders 34. The connecting rod 47 and piston head 48 of each piston member 46 are of one-piece construction, the piston head being in the form of an annular disk 50 provided with a circumferential groove 52 in its outer peripheral edge 51. The edge 51 has a convex curvature in an axial direction so that the cylinder wall will remain on a tangent to the peripheral edge 51 notwithstanding slight movement of the piston head away from the longitudinal axis of the cylinder as it is reciprocated through the cylinder. The groove 52 is dimensioned for insertion of a seal 53 and backing member 54 behind the seal. Radially inner wall 56 of the disk tapers into a shoulder 57 which is united with an enlarged end 58 of the connecting rod 47.

Figure 7:
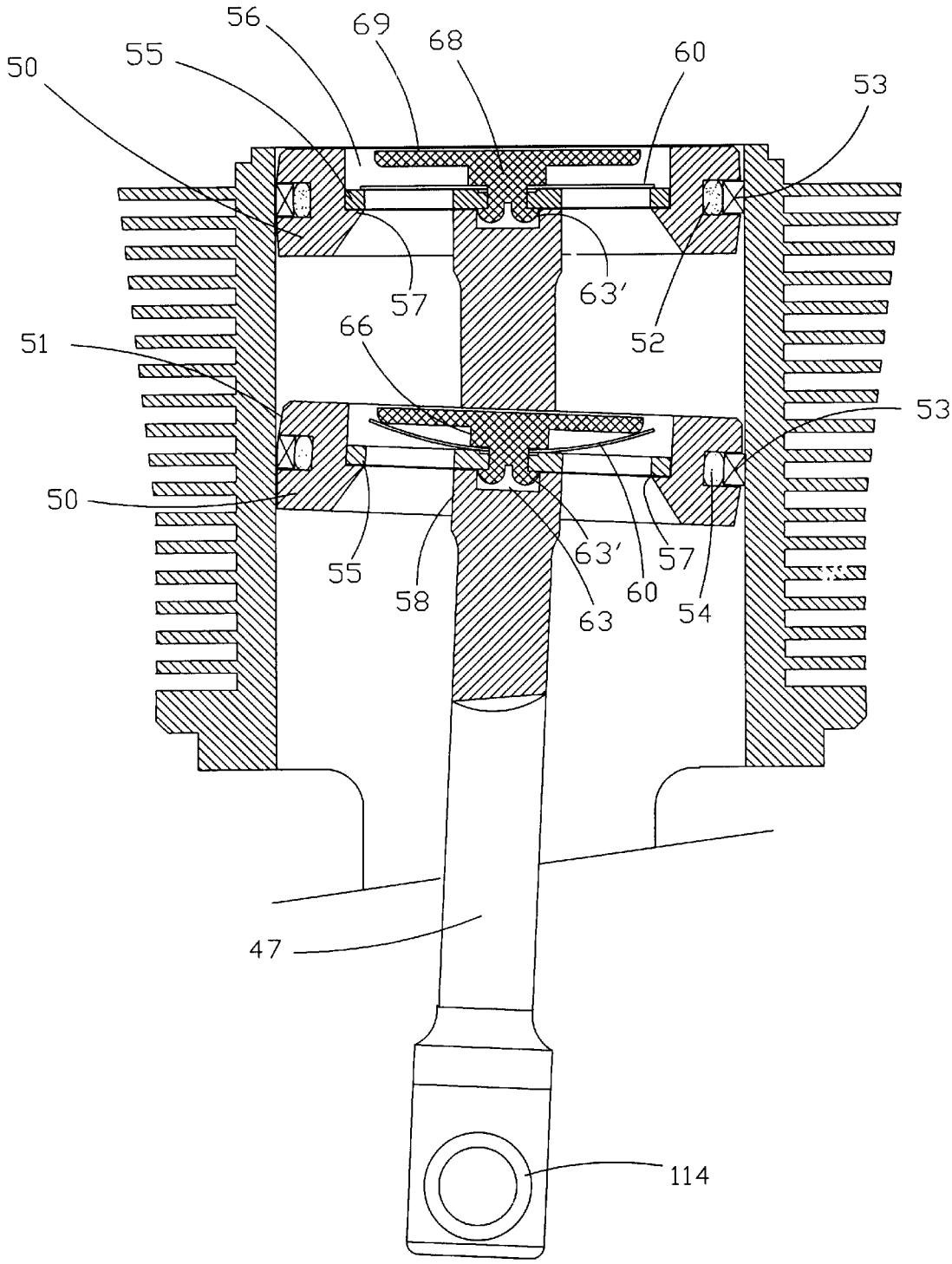
FIG. 7 is an enlarged view in more detail illustrating progressive movement of a piston head through a cylinder in accordance with the present invention.
Figure 8:
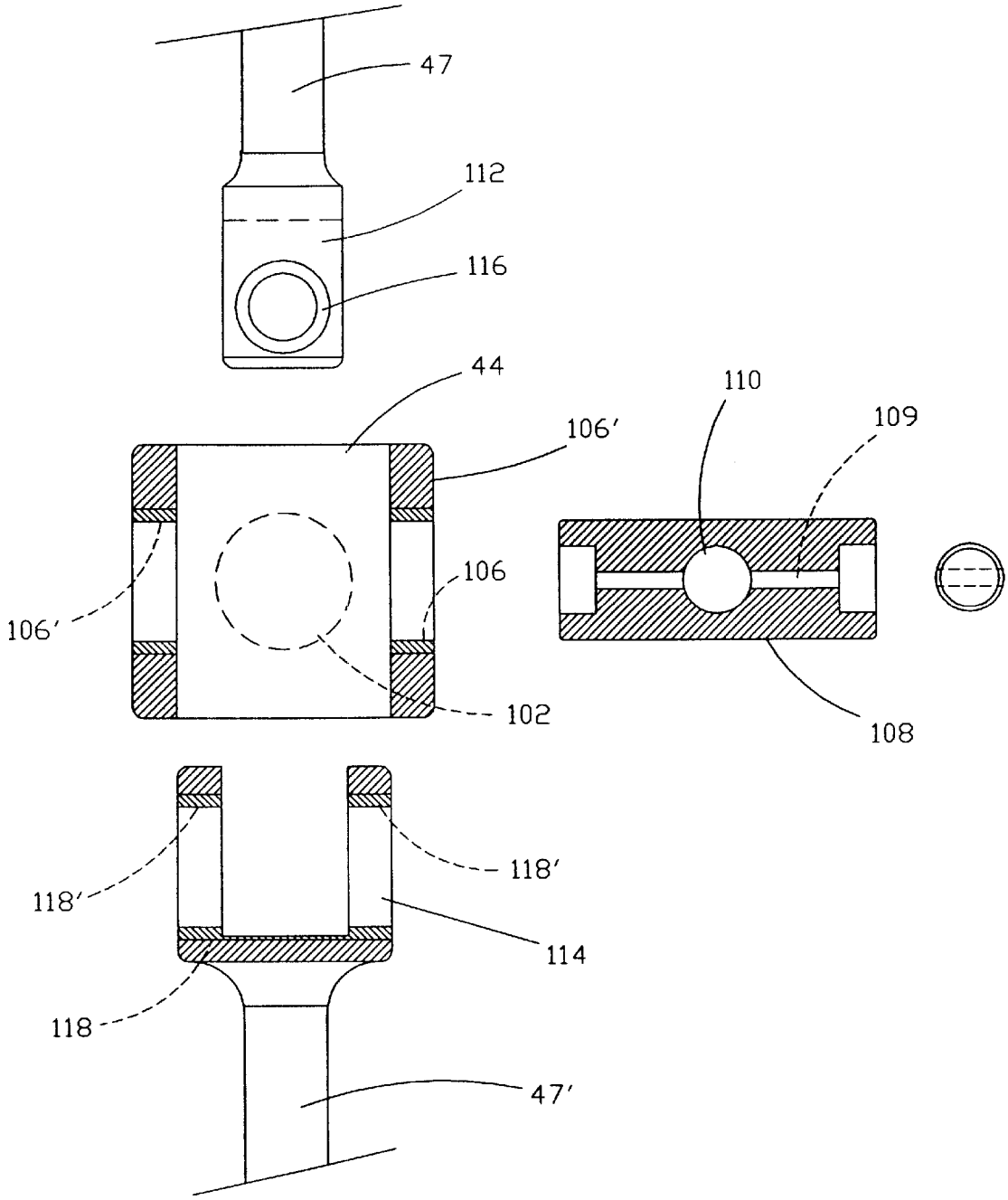
FIG. 8 is an exploded view of the common connecting end between a pair of piston members in accordance with the present invention.
Figure 11:
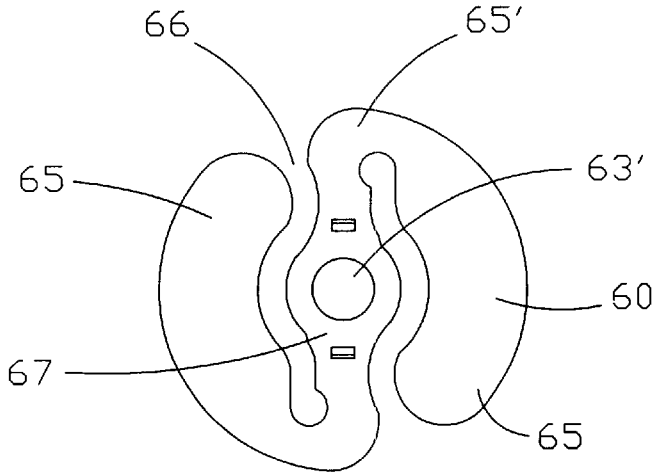
FIG. 11 is a top plan view of the leaflet valve member.
Figure 9:
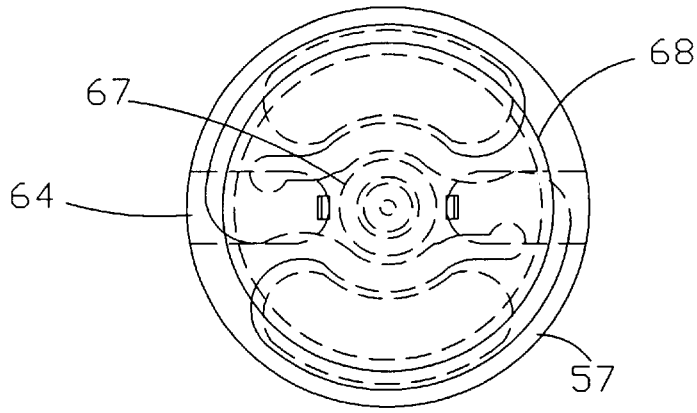
FIG. 9 is a top plan view of a preferred form of piston head and leaflet valve mounted thereon.
Figure 10:
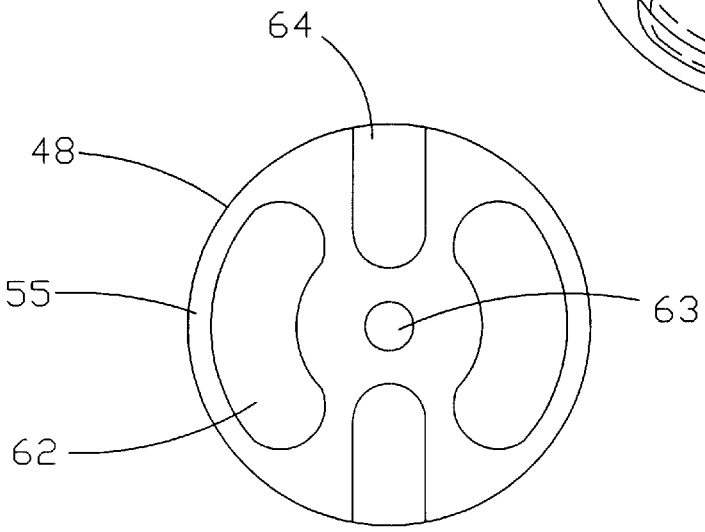
FIG. 10 is a top plan view of the piston head without the leaflet valve member mounted thereon.

As seen from FIGS. 7 and 9 to 11, a valve seat 55 is mounted on the shoulder 57 and is provided with a pair of diametrically opposed, kidney-shaped openings or ports 62 flanking a central bore 63 and further provided with diametrically opposed recesses 64 between the ports 62. As shown in FIGS. 7, 10 and 11, the leaflet valve 60 is secured at its center to the valve seat 55 by rivet 63' extending downwardly from limit stop 68 through the aligned central opening 63 in the leaflet valve 60 in the valve seat 55 until it is positioned behind the valve seat in a central recessed portion of the enlarged end 58 of the connecting rod 47. The leaflet valve 60 is generally S-shaped and is characterized by having diametrically opposed leaflet portions 65 separated by elongated slits 66 from the central portion 67 so that the outer leaflet portions 65 are free to flex about radial connecting portions 65' at diametrically opposed ends of the center portion 67. The leaflet portions 65 are dimensioned to slightly overlap the ports 62 with the central portion 67 at least partially overlapping the radial groove 64, as best seen from FIG. 9. As a result, the leaflet portions 65 are free to flex away from the center portion 67 as each piston moves away from its associated cylinder head. The limit stop 68 includes an enlarged solid disk-shaped portion 69 which is mounted in inner spaced concentric relation to the disk 50 with its outer peripheral edge dimensioned such that it will be in the path of movement of the outer peripheral leaflet portion 65. By controlling the mass of the leaflet portions 65' at their farthest distance from their common center portion 67, it is possible to match the inertia of the wobble piston 46 with the mass of the leaflet portions 65 to snap the leaflet portions open instantly when movement of the piston is initialized. This increases the duration of the valve opening and results in increased compressor efficiency.

Figure 12:
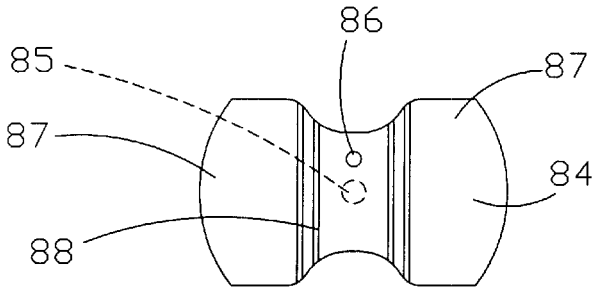
FIG. 12 is a top plan view of the exhaust valve member.
Figure 13:
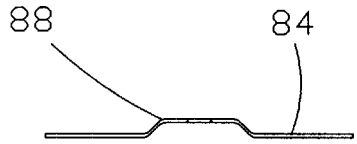
FIG. 13 is a cross-sectional view taken about lines 13—13 of FIG. 6.
Figure 15:
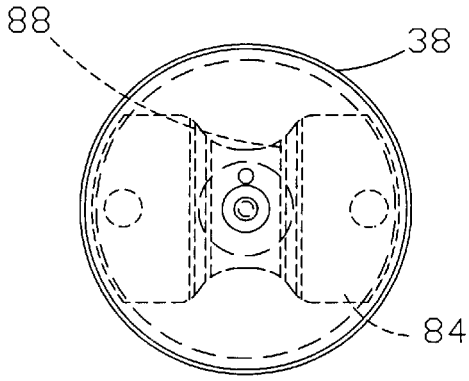
FIG. 15 is a top plan view of the exhaust valve and leaflet mounted thereon.
Figure 14:
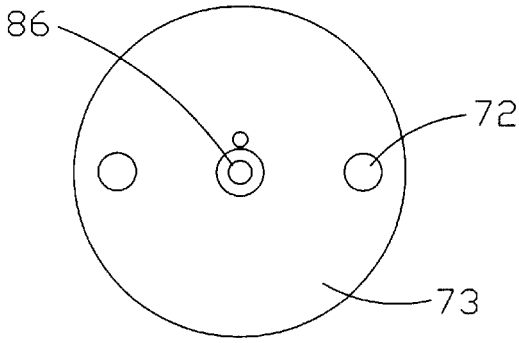
FIG. 14 is a detailed view partially in section of the preferred form of universal port connector between each pair of piston rods and swash plate.

Again, FIG. 3 illustrates an exhaust valve 38 which comprises diametrically opposed ports 72 in a valve seat 73. The valve seat 73 is mounted in an air chamber 74 formed in the faceplate or cylinder head 75 and which communicates through an air passage 76 with a tubular conduit 78 extending between the faceplate 75 and the manifold M. Similarly, those cylinders 34 at the end opposite to the motor 22 communicate with air chambers 74' in a common cylinder head 75', each air chamber communicating through an opening 82 with the common manifold M. As further seen from FIGS. 12 to 14, each exhaust valve 38 includes a valve member 84 having a center hole 85, a locator bore 86 and a pair of diametrically opposed leaflets 87 which are flexible or hinged about weakened or living hinge portions 88. Each valve member 84 is mounted on the valve seat 73 by a rivet 90 insertable through an aligned opening 85 in the valve 84 and the bore 86 in the valve seat 73. A solid disk-shaped limit stop 92 is mounted on the rivet 90 in axially spaced relation to the valve seat 73 so as to project into the air chamber in spaced overlying relation to the valve leaflet member 84.

In order to establish a universal connection between aligned pairs of piston rods 47 and the swash plate 26, each universal connector or yoke 44 has a connecting pin 102 inserted into a bushing 103 which is pressfit in a radial bore in the swash plate 26, as shown in FIG. 4. The bifurcated end of the yoke 44 has flat parallel sides 104 with aligned holes 106 in the sides 104 in which bushings are inserted to receive a common two-way joint or connecting shaft 108. The shaft 108 has a center bore 109, and a transverse bore 110 intersects the bore 109, each of the bores 109 and 110 having roll pins 109' and 110' inserted therein to hold the entire assembly together in a manner to be described.

Referring to FIGS. 5 to 8, 16 and 17, connecting rod 47 of one of the aligned piston members terminates in a male end portion 112 and the complementary piston rod 47' of the pair terminates in a bifurcated end portion 114 which is insertable in the yoke 44 and is adapted to receive the male end 112 of the complementary piston. The male end 112 includes an opening 116 which is aligned with openings 118 in opposite sides of the bifurcated end 114 and are dimensioned for insertion of the shaft 108 into close fitting but journaled relation to the aligned openings 116 and 118. Suitable bearings 106' and 118' are positioned in the aligned openings 106 and 118. In this way, a mutually perpendicular, two-way joint is established to eliminate bending stresses between the connecting rods of each pair with respect to one another and with respect to the swash plate. Of course, the somewhat wave-like pattern of the swash plate is imparted to the connecting rods 47 and 47A so as to cause them to rotate about a first axis through the shaft 108. This first axis extends perpendicular to an imaginary radial line from the center of the swash plate through the center of the shaft 108. In addition, somewhat slightly limited rotational motion of the swash plate causes the yokes 44 to rotate about their connecting pins 102 to the swash plate 26, and the common connecting ends of the piston rods 47 and 47' rotate also with respect to one another about an axis through the connecting shaft 108 of each yoke 44.

The universal joint between the connecting ends of each piston pair enables the piston rods to rotate about the two mutually perpendicular axes as they are driven by the swash plate and thus eliminate bending stresses on the piston rods 47 and 47'. There is of course a resultant displacement of each piston head 50 with respect to a cylinder wall, as illustrated in FIG. 7, and this is compensated for by the convex curvature of the disks 50 and flexible mounting of the seals 53 which make direct contact with the cylinder wall and adequately compensate for any displacement of the piston head away from the longitudinal axis of the cylinder. It is important to note that, as each piston head approaches the end of the cylinder, the piston rod will have returned to axial alignment with the longitudinal axis of the cylinder.

Figure 16:
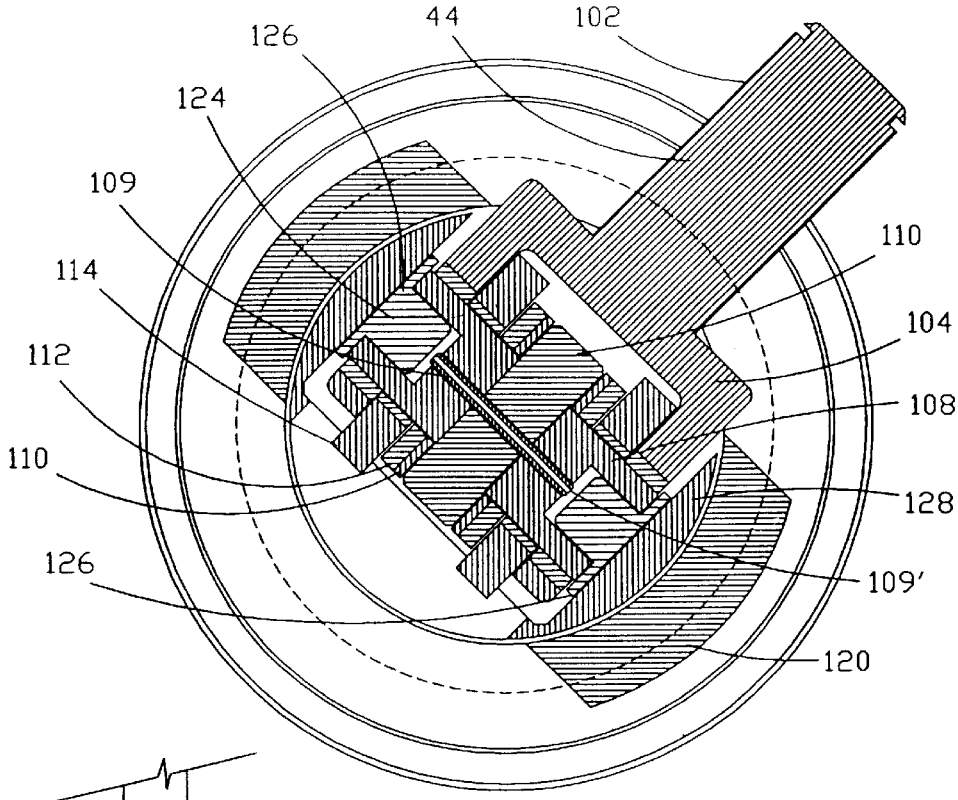
FIG. 16 is a cross-sectional view of the preferred form of U-joint connection and surrounding stabilizer taken about lines 16—16 of FIG. 6.
Figure 17:
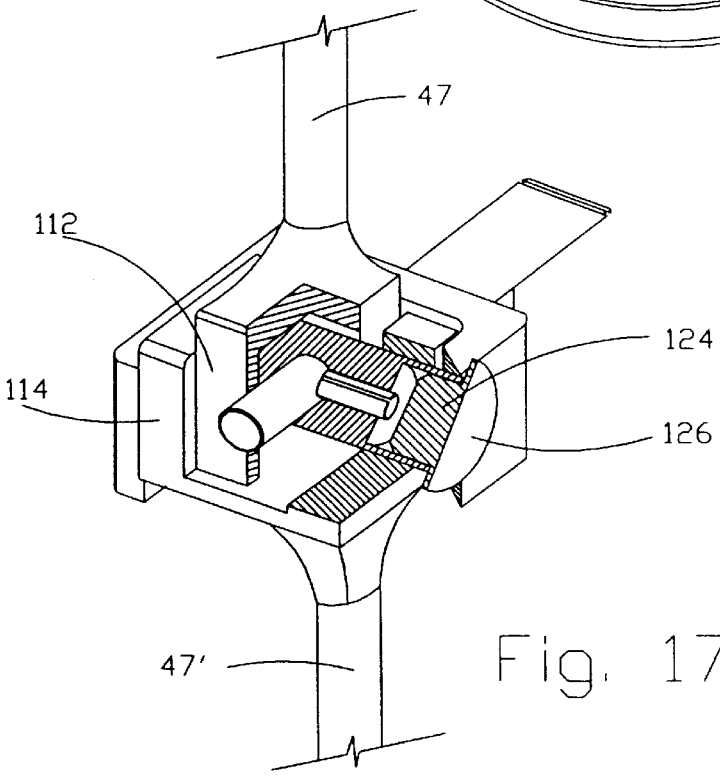
FIG. 17 is a perspective view with portions broken away of the preferred form of U-joint connection in accordance with the present invention.

A stabilizer tube 120, as best seen from FIGS. 3, 16 and 17, is interposed between aligned pairs of cylinders and is permanently affixed at each end to a cylinder 35 by an enlarged connecting flange 122. The shaft 108 which is mounted in the end of the yoke 44 has bores at opposite ends into which a bearing member in the form of a plastic plug 124 is inserted, each plug 124 being composed of a low friction, high-strength plastic material having an enlarged circular end 126. The ends 126 of the plugs 124 bear against flat surfaces of diametrically opposed, chordal-shaped stabilizer guide rails 128 within the stabilizer tube 120. The plugs 124 are free to undergo slidable movement with respect to the guide rails 128 as the pistons 47 and 47' are reciprocated. In this relation, a bolt or other suitable fastener is inserted at 130 through the stabilizer tube 120 into a corresponding bore in each guide rail 128 to anchor the guide rails 128 firmly in place within the guide tube. A particular feature of the swash plate of this invention is that it is more balanced than in my hereinbefore referred to U.S. Pat. No. 6,099,268 in applying pressure in both directions via the shuttle wobble piston assembly in cooperation with the U-joint connection.

It will be appreciated that incorporation of the intake valve 60 into the piston head 48 results in greatly increased valve opening displacement making it possible to draw more air into the cylinder during each piston stroke. The valve leaflet configuration contributes to this in controlling the force required to open and close the valve without sacrificing strength needed to withstand the air pressure against the leaflet. The lesser the force required to open the valve 60, the higher efficiency is achieved which can be determined by measuring the negative pressure or vacuum in the cylinder 34 and observing the opening of the intake valve 60 in response to the vacuum created. The vacuum is created as the piston moves away from the cylinder head and increases until the atmospheric air pressure overcomes the intake valve leaflet tension to open and fill the cylinder with fresh air. The distance of piston movement necessary to open the intake valve 60 in relation to the total stroke can be expressed in percentage of the stroke movement and can be calculated in real time. The more time available for the intake valve 60 to remain open, the more air that is permitted to enter the cylinder and the higher the efficiency realized. By placing the intake valve 60 in the piston head 48, it is possible to take advantage of the rapid acceleration of the piston traveling away from the cylinder head or exhaust valve 38. This acceleration will at a given point overcome the leaflet sluggishness or inertia; and, by controlling the mass of the leaflet at its greatest distance from the flex point, can match the inertia of the piston 46 with the mass of the leaflet to cause the intake valve 60 to open as soon as the piston moves away from the exhaust valve 38. Again, therefore, this maintains the intake valve 60 in an open position during its intake stroke away from the exhaust valve thereby substantially increasing compressor efficiency.

Conversely, it is desirable to control opening movement of the exhaust valve 38 during the compression portion to achieve the optimum pressure level for a given amount of air capacity. Mounting of the pistons and cylinders in opposed axial alignment with one another as described results in greatly increased air capacity for a given size or diameter of compressor as well as achieving optimum balance or stability in driving the pistons in tandem. Preferably, the leaflet valve member 65 can be composed of high carbon spring steel, alloy steel, stainless steel, non-ferrous alloy or high temperature alloy which is cold drawn and heat treated before fabrication. The thickness of the valve member 65 depends to some extent on the size of the valve to be installed in the piston but is roughly 18 to 24 gauge and, after heat treatment, is coated with a layer of TEFLON® 2 to 3 microns thick. The weakened portion 68 which acts as a hinge member will control the amount of opening and closing force required.

It will be appreciated from the foregoing that the unitary piston members 46 or 46' and the intake valves 50 associated therewith are readily conformable for use in standard oil-free compressors, such as, the compressor system set forth and described in my hereinbefore referred to U.S. Pat. No. 6,099,268. The exhaust valve member 84 may be composed of the same materials as the intake valve leaflet 65. The gauge or thickness of the valve members 65 and 84 must be calculated to be able to withstand tank pressure. In order to assemble the shuttle piston assembly together with the stabilizer tube 120, the tube 120 is provided with a bore 132 for insertion of the connecting rod shaft 108 into the assembled yoke 44 and the common connecting ends 112, 114 of the pistons 47 and 47'.

While a preferred form of invention is herein set forth and described, it is to be understood that various modifications and changes may be readily made in the construction and arrangement of elements as well as composition of materials making up the elements of the preferred form of invention without departing from the spirit and scope thereof as defined by the appended claims and reasonable equivalents thereof.

I claim:

1. In an air compressor, a plurality of circumferentially spaced cylinders arranged in pairs with said cylinders of each of said pairs arranged on a common axis and facing away from one another, each of said cylinders including a cylinder head at one end and an exhaust valve therein;

a piston assembly including a connecting rod extending between each of said pair of said cylinders and a pair of piston heads mounted on each of said connecting rods facing away from one another for extension through said cylinders of each said pair, each said piston head having an intake valve movable between open and closed positions in response to reciprocal movement of said piston head away from and toward respective said cylinder heads each of said exhaust valves movable to an open position as said piston head approaches said cylinder head at the end of its stroke; and motive drive means for imparting reciprocal motion to each of said connecting rods and respective of said piston heads including a drive shaft and a swash plate to impart reciprocal motion to said piston heads.

2. In an air compressor according to claim 1 wherein said piston heads of each said pair are mounted at opposite ends of each of said connecting rods.

3. In an air compressor according to claim 1 wherein each of said connecting rods and said pistons on each of said connecting rods are of one-piece construction.

4. In an air compressor according to claim 1 wherein each of said intake valves comprises a valve seat on said piston head in facing relation to said exhaust valve of an associated of said cylinders and a valve element disposed in each of said valve seats.

5. In an air compressor according to claim 4 wherein said valve element is in the form of a leaflet disposed on said valve seat.

6. In an air compressor according to claim 5 wherein each of said leaflets is movable to an open position away from said valve seat in response to movement of said piston head away from said exhaust valve.

7. In an air compressor according to claim 6 wherein each said valve seat includes a pair of diametrically opposed openings in said piston head, and said leaflet includes diametrically opposed leaflet portions surmounted on said openings of said valve seat.

8. In an air compressor according to claim 4 wherein each of said piston heads includes a seal on an outer peripheral edge thereof.

9. In an air compressor according to claim 8 wherein said seal seal is inserted in a groove in said peripheral edge.

10. In an air compressor according to claim 9 wherein each of said piston heads is in the form of a disk having a convex surface on said peripheral edge.

11. In a compressor, a plurality of circumferentially spaced cylinders arranged in pairs with said cylinders of each of said pairs arranged on a common axis and facing away from one another, each of said cylinders having a cylinder head at one end including an exhaust valve therein;

a plurality of piston members arranged in circumferentially spaced pairs, each pair including a pair of piston heads facing away from one another for extension into one of said cylinders of each said pair and having an intake valve therein, and each of said pairs of piston members having piston rods extending away from connecting ends and terminating in said piston heads at opposite ends;

each of said piston heads being of generally convex configuration having a valve seat in facing relation to said exhaust valve of an associated of said cylinders, and a valve element in the form of a leaflet mounted in normally closed relation to said valve seat, said leaflet including diametrically opposed leaflet portions surmounted on openings in said valve seat; and a power source having an output drive shaft and a swash plate mounted on said shaft to undergo reciprocal motion in response to rotational motion of said shaft.

12. In a compressor according to claim 11 wherein an outer peripheral portion of said swash plate is connected to an intermediate portion of each of said connecting ends, said connecting ends arranged at circumferentially spaced intervals about said swash plate.

13. In a compressor according to claim 12 wherein a two-way joint interconnects each of said connecting ends to said swash plate about two mutually perpendicular axes, said axes being mutually perpendicular to said output drive shaft whereby precessional motion of said swash plate causes each of said piston heads to be coaxially aligned with a respective one of said cylinders at the end of each stroke.

14. In a compressor according to claim 13 including guide means within which each said two-way joint is slidable whereby to guide reciprocal movement of said piston rods.

15. In a compressor according to claim 14 wherein said guide means includes a pair of guide rails provided with bearing surfaces, said two-way joint including bearing members slidable with respect to said bearing surfaces as said piston rods are reciprocated.

16. In a compressor according to claim 15 wherein said guide means includes an outer stabilizer member of generally tubular configuration extending between said cylinders in surrounding relation to each said aligned pair of pistons, said guide rails mounted in said stabilizer member at opposite ends of a connecting shaft defining one of said mutually perpendicular axes.

17. In a compressor according to claim 16 wherein said bearing members are mounted at said opposite ends of said connecting shaft.

18. In a compressor according to claim 11 wherein each of said cylinder heads includes an exhaust valve movable to an open position as said piston head approaches said cylinder head at the end of its stroke.

19. In a compressor according to claim 18 wherein each said exhaust valve includes a pair of diametrically opposed exhaust ports and valve members in the form of leaflets overlying said exhaust ports.

20. In a compressor according to claim 11 wherein said connecting ends include first guide means mounted on said swash plate for rotation of said piston rods of each said pair about a radial axis and second guide means for independent rotational movement of said piston rods of each said pair about an axis perpendicular to said radial axis.

21. In a compressor according to claim 11 wherein said connecting ends define a universal connector between said piston rods of each said pair.

22. In an air compressor having a plurality of cylinders with exhaust valves therein, the combination therewith comprising a unitary piston member for each of said cylinders including a piston rod and piston head at one end of said piston rod, each said piston head having an intake valve therein movable between an open and closed position in response to movement of said piston head through said cylinder, and a swash plate for imparting reciprocal movement to each of said piston members.

23. In an air compressor according to claim 22 wherein each of said piston heads is in the form of a disk having a substantially flat surface in facing relation to said exhaust valve in an associated one of said cylinders and a valve element disposed on said flat surface.

24. In an air compressor according to claim 22 wherein said valve element is defined by a generally S-shaped leaflet having diametrically opposed leaflet portions overlying air intake ports in said piston head.

25. In an air compressor according to claim 22 wherein each of said piston heads includes an outer convex peripheral edge surface and a seal mounted in a groove in said peripheral edge.

26. In an air compressor wherein a swash plate translates rotational motion of a shaft into precessional motion of said swash plate about said shaft, a plurality of pistons being reciprocal in response to the precessional motion of said swash plate to pressurize air introduced into a plurality of cylinders through which said pistons are advanced, the improvement comprising:

a stabilizer member disposed in outer surrounding relation to a connecting end of said piston to said swash plate, said stabilizer member including at least one bearing surface; and a complementary bearing surface on said connecting end of said piston slidable along said at least one bearing surface in a direction substantially parallel to reciprocal motion of said piston.

27. In an air compressor according to claim 26 wherein said at least one bearing surface includes a pair of diametrically opposed, spaced facing bearing surfaces in said stabilizer member, and a pair of complementary bearing surfaces on said connecting end being slidable along said pair of bearing surfaces.

28. In an air compressor according to claim 27 wherein said stabilizer member is of generally tubular construction and is affixed to said cylinder, and a pair of guide rails mounted in said stabilizer member, each provided with one of said pair of bearing surfaces.

29. In an air compressor according to claim 28 wherein said bearing surfaces are flat and said guide rails are spaced apart a distance such that said connecting ends are restrained against rotational motion in response to the precessional motion of said swash plate.

30. In an air compressor according to claim 26 wherein said plurality of cylinders are arranged in pairs with said cylinders of each of said pairs disposed on a common axis and facing away from one another, said pairs disposed in circumferentially spaced relation with respect to said swash plate, and a plurality of said pistons arranged in circumferentially spaced pairs, said circumferentially spaced pairs including piston heads facing away from one another for extension into one of said cylinders of each said cylinder pair and said connecting ends defining common connecting ends of said circumferentially spaced pairs being connected to said swash plate.

31. In an air compressor according to claim 30 wherein a two-way joint interconnects each of said common connecting ends to said swash plate about two mutually perpendicular axes, said joint including a common shaft having said complementary bearing surfaces at opposite ends thereof.

32. An air compressor comprising a plurality of circumferentially spaced cylinders arranged in pairs, said cylinders of each of said pairs disposed on a common longitudinal axis and facing away from one another, each of said cylinders having a cylinder head at one end including an exhaust valve therein, a plurality of piston members arranged in circumferentially spaced pairs, each pair including a pair of piston heads extending into one of said cylinders of each said pair and having an intake valve in each said piston head, each of said piston heads provided with a generally convex outer peripheral edge portion having a seal disposed in said peripheral edge portion for sealed engagement with each respective one of said cylinders, each of said pairs of piston members having piston rods extending away from a common connecting end, and motive drive means including an output drive shaft and swash plate mounted on said shaft to undergo precessional motion in response to rotational motion of said shaft whereby to impart reciprocal motion to said piston members.

33. An air compressor according to claim 32 wherein each of said piston heads includes an intake valve in facing relation to said exhaust valve of an associated of said cylinders and a leaflet valve element disposed in each of said valve seats, each said leaflet valve element being of generally S-shaped configuration, and a limit stop mounted in axially spaced relation to said leaflet valve element to limit opening movement of said element.

* * * * *